US006032759A

United States Patent [19]

Yeh

[11] Patent Number: 6,032,759

[45] Date of Patent: Mar. 7, 2000

[54] LADDER WITH ANTI-DEFORMED SIDE RAILS

[75] Inventor: Chin-Wen Yeh, Nuan-nuan, Taiwan

[73] Assignee: Dofair Company, Ltd

[21] Appl. No.: 09/159,003

[22] Filed: Sep. 23, 1998

[30] Foreign Application Priority Data

Aug. 3, 1998 [TW] Taiwan ..... 87212701

[51] Int. Cl.[7] ..... E06C 7/08

[52] U.S. Cl. ..... 182/228.1; 182/228.4; 182/219

[58] Field of Search ..... 182/219, 228.1, 182/217, 228.4, 194, 195

[56] References Cited

U.S. PATENT DOCUMENTS 3,734,237 5/1973 Howard ..... 182/219 X 3,997,027 12/1976 Patterson et al. ..... 182/228.4 X 4,998,982 3/1991 Arnlod et al. ..... 182/219 X

*Primary Examiner*—Daniel P. Stodola

*Assistant Examiner*—Hugh B. Thompson

*Attorney, Agent, or Firm*—Connolly Bove Ludge & Hutz LLP

[57] ABSTRACT

A ladder with anti-deformed side rails comprises two tubular side rails, a plurality of rungs, and two tubular inner bushings. Each of the bushings is tightly fitted with the inner surface of each side rail respectively and passed through by the respective end of the lowest rung. Additionally, the longitudinal length of the bushings ranging from 2/5 to 3/5 of the distance between two neighbor rungs, and the thickness of the bushings ranging from 4/5 to 1 of the thickness of the side rails lead to an optimum bending strength for the side rails.

1 Claim, 4 Drawing Sheets

LADDER WITH ANTI-DEFORMED SIDE RAILS

BACKGROUND OF THE INVENTION

1. Field of the Invention

The present invention relates to a ladder with anti-deformed side rails, particularly to a ladder, which has inner bushings of certain sizes inserted in the feet of the side rails to prevent the side rails from undergoing permanent deformation.

2. Description of Related Art

For mounting rungs of a metal ladder on the side rails thereof, the rungs extend beyond the side rails, held therein by retaining protrusions. The rungs have bend back ends instead of bolts, nails, supporting brackets or other conventional fasteners. This structure allows for light and inexpensive ladders, which are convenient to use. However, during use of such a ladder large loads may rest on the feet of the side rails. The side rails are thus deformed and may even break. To overcome this deficiency, ladders with a additional bottom bar 8 have been designed, as shown in FIG. 6. The bottom bar 8 enhances stability of the ladder. However, the bottom bar 8 is fixed to the side rails by bolts or nails, which tend to loosen, reducing stability of the ladder. Furthermore, since the bottom bar 8 extends considerably beyond the side rails, the ladder is inconvenient to store and to transport, and production cost is high.

SUMMARY OF THE INVENTION

The present invention improves on the shortcomings described above. The main characteristic of the present invention is inner bushings tightly fitted in side rails. The inner bushings have outer surfaces thereof press against the inner surfaces of the side rails. Each of two opposite lateral sides thereof provides a hole to be extended by the lowermost rung. When the ratio of the length of each inner bushing to the distance between neighboring rungs ranges from 2/5 to 3/5 and when the ratio of the wall thickness of each inner bushing to the wall thickness of each side rail ranges from 4/5 to 1, an optimum bending strength of the side rail can be achieved. Therefore, by employing the inner bushings, the ladder will not be permanently deformed when heavily loaded and will not break. At the same time, the ladder is light and convenient to use. Since the inner bushing is tightly fitted in the side rails and retained by the rung, a good strength of the ladder can be achieved even if no further outer supports on the ladder are used.

The main object of the present invention is to provide a ladder with anti-deformed side rails, wherein an inner bushing is tightly fitted in each of the side rails respectively to prevent the side rails from being permanently deformed when heavily loaded.

Another object of the present invention is to provide a ladder with anti-deformed side rails, which still can keep light and convenient while using.

BRIEF DESCRIPTION OF THE DRAWINGS

The present invention can be more fully understood in the following description with reference to accompanying drawings, in which.

DETAILED DESCRIPTION OF THE PREFERRED EMBODIMENT

Figure 1:
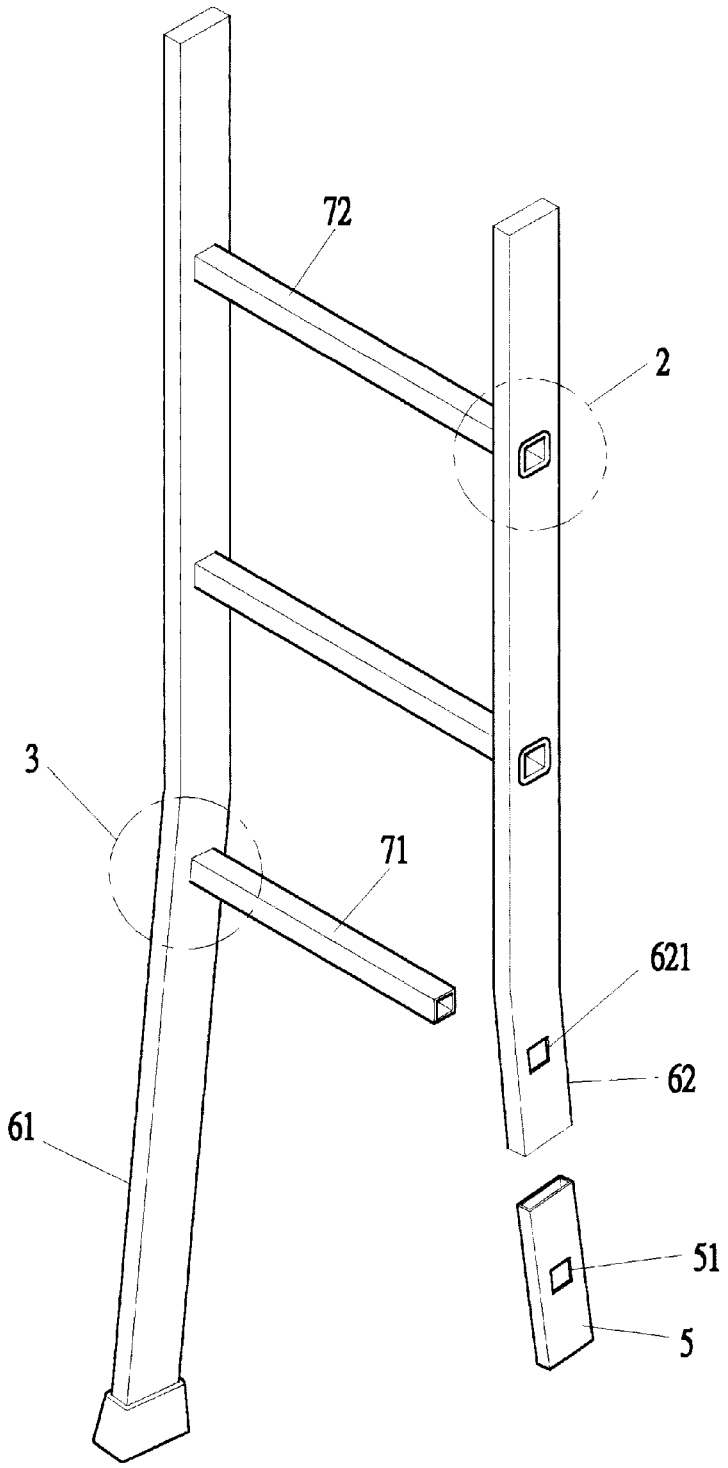
FIG. 1 is a partial perspective view of the ladder of the present invention.
Figure 3:
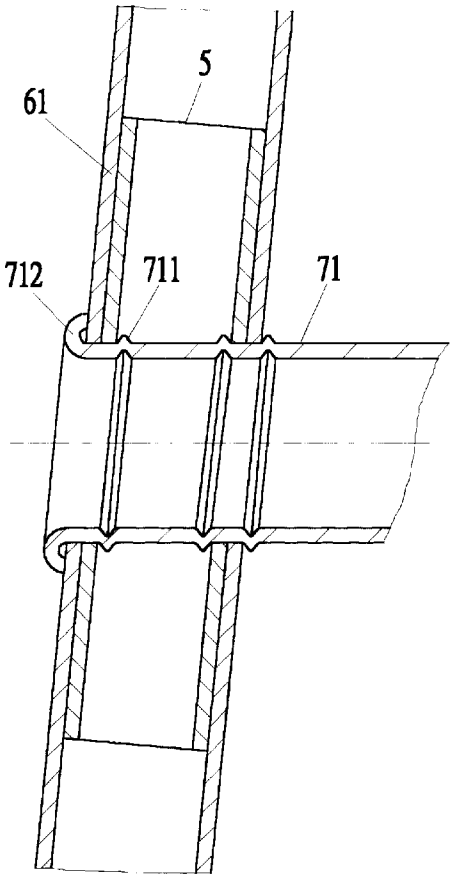
FIG. 3 is an enlarged side view of the parts within the circular chain line 3 of FIG. 1, showing how the inner bushing of the present invention is mounted at the connection between one oblique side rail and the end of the lowermost rung.
Figure 2:
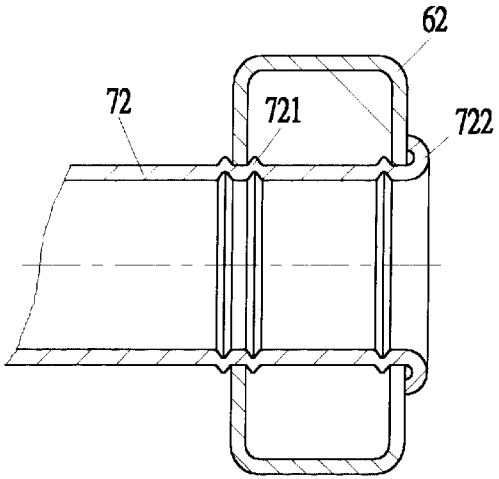
FIG. 2 is an enlarged top view of the parts within the circular chain line 2 of FIG. 1.
Figure 6:
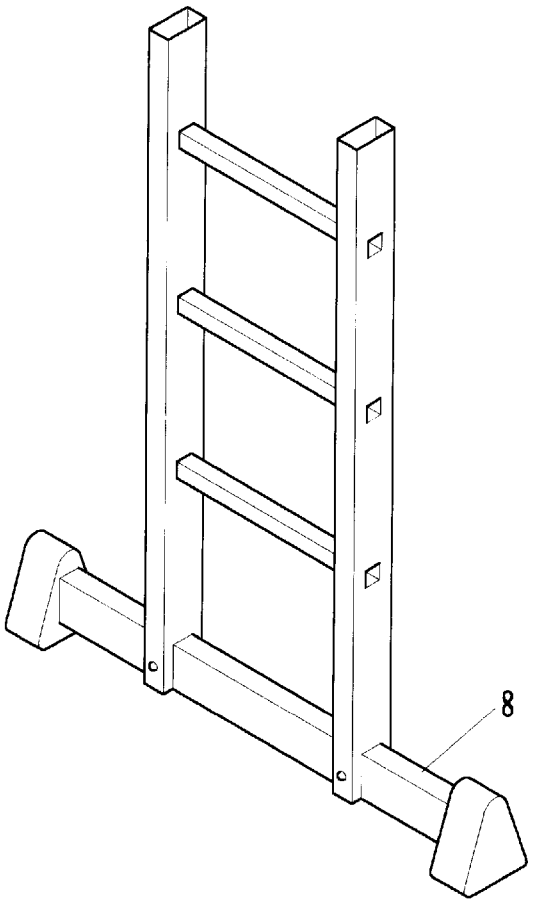
Fig. 6 (PRIOR ART)
FIG. 6 is a partial perspective view of a conventional ladder with an additional bottom bar.

Referring to FIGS. 1, FIG. 2 and FIG. 3, the light ladder of the present invention comprises two side rails with oblique feet 61, 62, which are hollow with inner surfaces; a plurality of rungs 72; and a lowermost rung 71. Each of the rungs 72 has two ends, which are connected to the side rails 61, 62, respectively. As shown in FIG. 2, three retaining protrusions 721 clamp walls of the side rail 62. The ends of the rungs 72 form bend back ends 722 to hold the side rail 62, requiring no further fastening elements, as is conventional art with metal ladders. As shown in FIG. 1, an inner bushing 5 with an outer surface is inserted into the side rail 62, with the inner surface thereof contacting the outer surface of the bushing 5. The inner bushing 5 has aligned holes 51 on two lateral sides thereof. The side rail 62 has aligned holes 621 of equal size either. When the bushing 5 is mounted inside the side rail 62, the holes 51 and 621 are aligned, allowing the lowermost rung 71 passing through. Oppositely, the lowermost rung 71 provides retaining protrusions and a bend back end to connect the side rail 61 with the inner bushing 5 too. FIG. 3, an enlarged view of the parts inside the chain line 3 of FIG. 1, shows the inner bushing 5 mounted inside the side rail 61, with the lowermost rung 71 connected thereto. Two retaining protrusions 711 fixedly connect the lowermost rung 71 to the inner bushing 5, and one retaining protrusion 711 and a bend back end 712 fixedly connect the lowermost rung 71 to the outer surface of the side rail 61.

Figure 4:
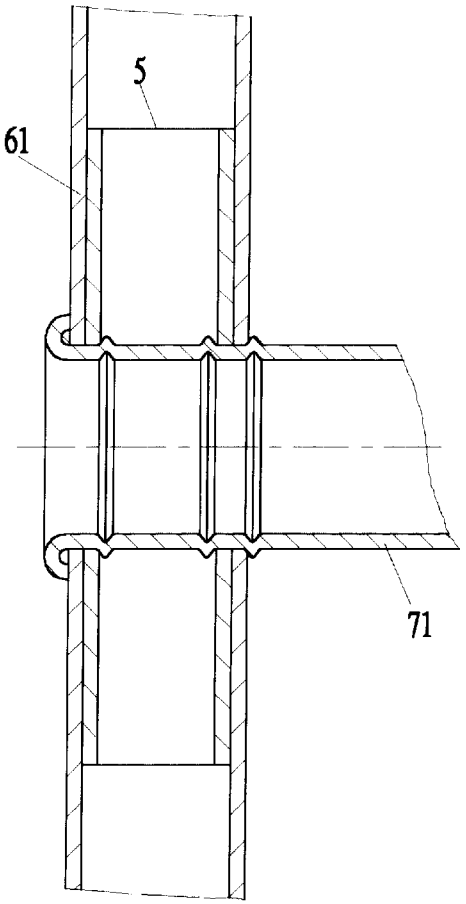
FIG. 4 is an enlarged side view of the parts within the circular chain line 3 of FIG. 1, showing how the inner bushing of the present invention is mounted the connection between one upright side rail and the end of the lowermost rung.

As shown in FIG. 4, a second embodiment of the present invention has a side rail 61 with upright foot instead of oblique foot. The same arrangement of the inner bushing 5, the lowermost rung 71 and the side rail 61 is employed with accordingly modified angles.

Figure 5:
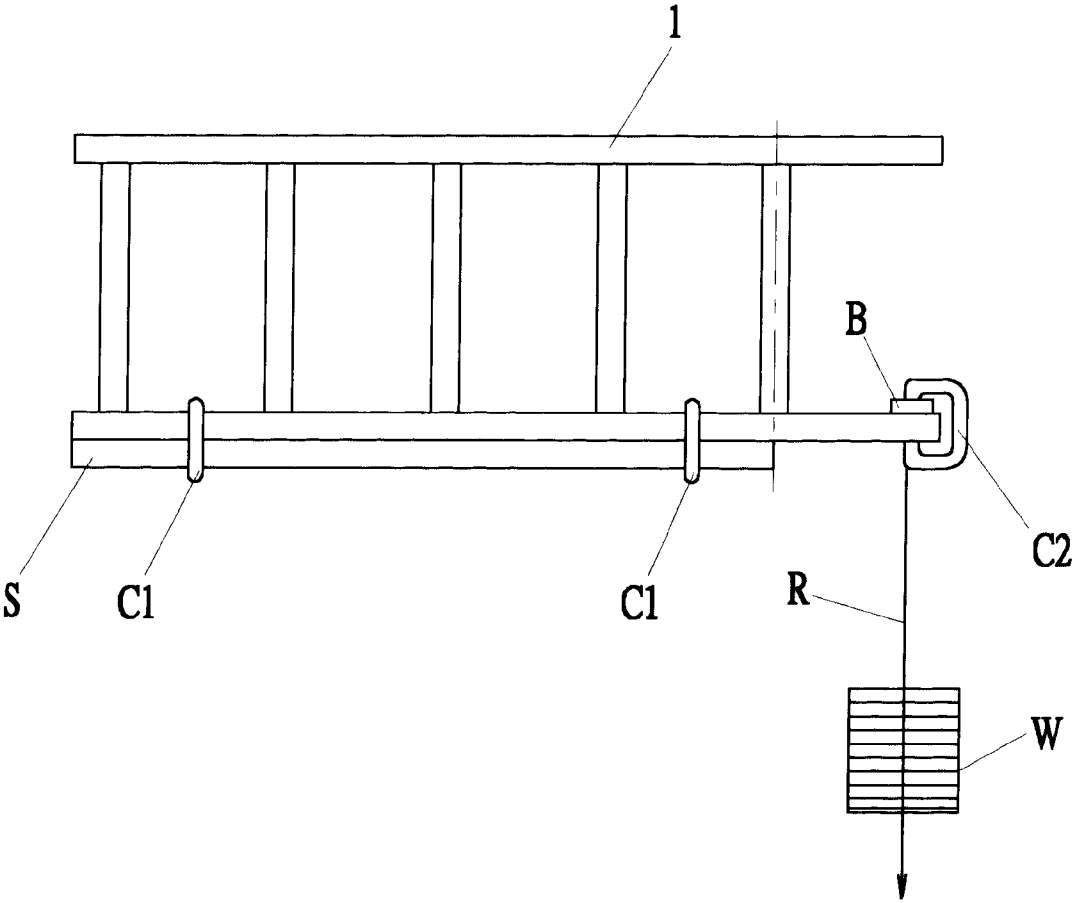
FIG. 5 is a schematic illustration of a deformation test on the foot of the side rail a ladder.

Preventing the side rails 61, 62 from permanent deformation under heavy load is a key feature of the present invention. Another feature of the present invention is to keep a ladder low weight and convenience while using. Considering both features, an optimum size of the inner bushing 5 is extraordinarily important. FIG. 5 shows a standard deforming test for the side rails on a ladder 1. Therein, two C-clamps C1 hold a side rail of the ladder 1 on a horizontal support S with an end. The rungs of the ladder are vertically oriented. The lowermost rung has a central axis passing through the end of the support S such that the lowest section of the tested side rail is not supported. A block B is attached to the lower end of the tested side rail by a C-clamp C2. A test load W is suspended from the block B by a rope R. The arrangement shown in FIG. 5 constitutes a static cantilever bending test for the lower side rail only. A bending test for the other side rail is similar and not further explained. The test has been described in detail in American National Standard A-14.2-1990. The test on the ladder of the present invention shows that in order to minimize the permanent deformation and a weight of the ladder, an optimum bending strength of the side rails can be achieved by means of arranging the length of the inner bushing and the wall thickness thereof. It is found that the ratio of the length of each inner bushing to the distance between neighboring rungs ranges from 2/5 to 3/5 and the ratio of the wall thickness of the inner bushing to the wall thickness of each side rail ranges from 4/5 to 1, an optimum bending strength can be well achieved.

The side rails used in the test is made of regular 6063 aluminum alloy (Al—Mg—Si forging alloy) with a heat treatment of grade T5, which has following properties: a maximum tensile strength of 19 kg/mm$^2$, a maximum shear strength of 12 kg/mm$^2$, a 0.2% yield strength of 15 kg/mm$^2$, and a fatigue strength of 7.0 kg/mm$^2$. The side rails had a cross-section with a longer side of 62.85 mm and a shorter side of 23.9 mm, with a thickness of 1.25 mm on the longer side and a thickness of 1.35 mm on the shorter side. According to American National Standard, the distance between neighboring rungs is 305 mm. With an extra heavy duty test load of 500 pounds (227.27 kg), the feet of the side rails would break, when not reinforced by inner bushings. Each inner bushing has a size with the following data: a length of 122 mm (2/5 of the distance between, neighboring rungs), a thickness of 1 mm at the longer side of the cross section thereof (4/5 of the thickness at the longer side of the cross section in the side rail), and a thickness of 1.08 mm at the shorter side of cross section thereof (4/5 of the thickness at the shorter side of the cross section in the side rail), then the side rail occurs 1 mm bent deformation after testing. Each inner bushing has a size with the following data: a length of 183 mm (3/5 of the distance between neighboring rungs), a thickness of 1.25 mm at the longer side of its cross section (equal to the thickness at the longer side of the cross section in the side rail), and a thickness of 1.35 mm at the shorter side of the cross section thereof, that is equal to the thickness of the cross section in the side rail, then the side rail occurs no bent deformation after testing.

While the present invention has been described with reference to preferred embodiments thereof, it is to be understood that modifications and variations may be easily made without departing from the sprit of this invention which is defined by the appended claim.

I claim:

1. A ladder with anti-deformed side rails, comprising:

two hollow side rails, each of said two side rails having an inner surface respectively;

a plurality of rungs with two lateral sides, said plurality rungs fixedly connecting said two side rails, providing a predetermined distance between any two neighboring ones of said plurality of rungs; and a lowermost rung with two ends, said two ends fixedly connecting said two rails; and two inner bushings, said two inner bushings providing an outer surface and two lateral sides, being shorter than the predetermined distance between said any two neighboring rungs, and being inserted into said two side rails respectively;

characterized in that each of said two inner bushings being in the hollow side rails having the outer surface thereof tightly fitting with the inner surface of the side rails respectively, each of said inner bushings having a first aligned hole and a second aligned hole on said two lateral sides thereof respectively, each of said side rails having a third aligned hole and a fourth aligned hole on said two lateral sides thereof corresponding to said first and second holes, said four aligned holes being passed through by said lowermost rung, said lowermost rung having at each of said two ends thereof first and second retaining protrusions fixedly connecting said lowermost rung to the inner surface of each of said inner bushing and to said side rails, and a third retaining protrusion and a bend back end of said lowermost rung fixedly connecting the outer surface of each of said side rails to said lowermost rung.

* * * * *